United States Patent [19]

Kobler et al.

[11] Patent Number: 4,993,213

[45] Date of Patent: Feb. 19, 1991

[54] PACKAGING METHOD AND PACKAGE OBTAINED BY THIS METHOD

[75] Inventors: Erwin Kobler, Lausanne; Pierre Therond, Morges; Jacques Mury, Aubonne, all of Switzerland

[73] Assignee: SAPAL, Societe Anonyme des Plieuses Automatiques, Switzerland

[21] Appl. No.: 188,733

[22] Filed: Apr. 29, 1988

Related U.S. Application Data

[63] Continuation-in-part of Ser. No. 730,287, May 30, 1985, abandoned.

[30] Foreign Application Priority Data

May 7, 1984 [CH] Switzerland ..... 2211/84

[51] Int. Cl.[5] ..... B65B 11/02

[52] U.S. Cl. ..... 53/463; 53/466

[58] Field of Search ..... 53/461, 466, 491, 463, 53/229, 462; 229/87 F, 87 R

[56] References Cited

U.S. PATENT DOCUMENTS

| | | | |
|---|---|---|---|
| 1,398,569 | 11/1921 | Peterson | 53/466 |
| 1,869,584 | 8/1932 | Reymond | 229/87 F |
| 2,070,736 | 2/1937 | Johnson | 53/466 |
| 2,279,842 | 4/1942 | Smith | 229/87 R |
| 2,449,334 | 9/1948 | Smith | 229/87 R |

FOREIGN PATENT DOCUMENTS

| | | | |
|---|---|---|---|
| 2106535 | 10/1971 | Fed. Rep. of Germany | 53/234 |
| 327555 | 3/1958 | Switzerland | 53/229 |

*Primary Examiner*—John Sipos

*Attorney, Agent, or Firm*—Frost & Jacobs

[57] ABSTRACT

A method of packaging a rectangular moulded chocolate bar having a predetermined thickness, an upper face and a bottom face and bevelled longitudinal and lateral side faces, with a single sheet of heat sealable, composite multilayer material, by forming a longitudinal tube of the material completely around a bar with one longitudinal edge of the sheet projecting over another longitudinal edge and forming a covering flap, sealing the other longitudinal edge against an inner surface of the base of the covering flap, forming lateral folds which are first applied against the bevelled lateral side walls and then bent and applied on the ends of the bottom face, the lateral folds being made at each end of the tube, and folding the covering flap down over the bottom face in overlying relation to the lateral folds. The covering slap is sealed at least partially along a line parallel to a longitudinal edge of the flap, to provide a sealed and inviolable package.

5 Claims, 1 Drawing Sheet

PACKAGING METHOD AND PACKAGE OBTAINED BY THIS METHOD

CROSS-REFERENCE TO RELATED APPLICATION

This application is a continuation-in-part of Ser. No. 06/730,287, filed May 30, 1985, now abandoned in the names of the same inventors.

BACKGROUND OF THE INVENTION

The present invention relates to a method of packaging a rectangular moulded chocolate bar having a predetermined thickness, an upper face and a bottom face and bevelled longitudinal and lateral side faces, with heat sealable composite multilayer material.

Chocolate bars are usually packaged in a first package consisting for example of a multilayer sheet, in which one layer may be an aluminum film, which is either heat sealable or not, folded by an appropriate mechanism, known as such, and then in a second package consisting of a banderole or a printed paper label. This method, which has become conventional, continues to be used on a very large scale. However, it necessitates installations for supplying and folding at least two different packing materials. This type of packaging moreover does not necessarily meet the criterion of inviolability.

Chocolate bar packaging machines with a single operation have been developed, using one or several packaging materials folded simultaneously in a folding box. This type of package is neither sealed, nor inviolable.

Thus, at present, only cumbersome and costly machines with two operations are capable of achieving a sealed and inviolable package for chocolate bars presenting a conventional appearance. It is to be noted that chocolate bars, which have generally a thickness of about 7–12 mm, have to be packaged in a manner which respects the well known traditional packaging appearance having lateral folds and a bottom recovering flap having a trapezoidal shape. The lateral folds are necessary for getting rectilinear folding lines along the intersection lines of the adjacent bevelled side faces. These requirements are specific to chocolate bars which are usually moulded and have therefore a predetermined thickness of at least 7 to 12 mm and bevelled side faces which permit the withdrawal from the mould.

U.S. Pat. No. 2,449,334 disclosed a method for packaging a flat stick of chewing-gum with a sheet of a sealable material. It is to be noted that chewing-gum sticks have a very small thickness, of about 2 mm, and have generally rectangular side faces which are substantially perpendicular to the bottom and top flat faces of the stick. In these conditions, there is no need and it would even not be possible to provide folds presenting rectilinear folding lines on the intersection lines of two adjacent side faces.

SUMMARY OF THE INVENTION

In the present invention it is proposed to reduce the drawbacks mentioned above by achieving folding in a single operation, which presents the appearance as well as the advantages of folding of conventional type.

This object is achieved by the method according to the invention, with packing material consisting of a sheet of a web of heat sealable, composite multilayer material, comprising the steps of forming a longitudinal tube of packing material completely around the bar, so that the bar is located in a central part of said tube and so that one longitudinal edge of the sheet projects over another longitudinal edge and forms a covering flap, sealing said tube longitudinally by sealing said other longitudinal edge against an inner surface of the base of said covering flap along a longitudinal edge of said bottom face of the bar, forming lateral folds which are first applied against the bevelled lateral side walls and then bent and applied on the ends of the bottom face near the lateral side walls, these lateral folds being made at each end of the tube, and folding the covering flap down over the bottom face in overlying relationship to the lateral folds.

According to one object of the invention, the method includes the step of at least partially sealing the covering flap against the bottom face of the bar along a line parallel to a longitudinal edge of the flap, and located at the opposed edge of the sealed longitudinal edge.

Advantageously, the covering flap has a width substantially equal to the width of said bottom face of the bar.

The heat sealable, composite multilayer material is preferably aluminum coated with a thermally-sensitive adhesive layer.

According to another object of the invention, the method includes the step of sealing the lateral folds before bending the folds down against the bottom face of the bar.

BRIEF DESCRIPTION OF THE DRAWING

The present invention will be better understood with reference to the description of an example of a preferred embodiment and the accompanying drawing wherein.

DETAILED DESCRIPTION

Figure 1:
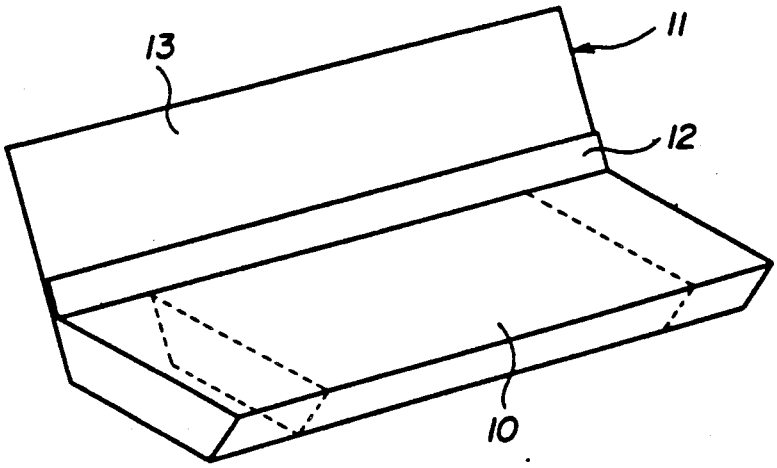
FIG. 1 represents a perspective view of a first phase of the method according to the invention, during which the tube of packing material is formed around the bar.

With reference to FIG. 1, a chocolate bar 10 is surrounded with a sheet 11 of packing material consisting of heat sealable multilayer material such as sealable aluminum, hence is coated with a thermally adhesive covering layer such as polyethylene, for example. A tube is formed around the bar and the edge 12 is sealed against the inner surface of the base of a covering flap 13 produced by asymmetrically disposing the two longitudinal edges of the sheet 11 as is shown in FIG. 1. This sealing zone is located along the edge of the bottom face which is opposed to the top of the bar 10. In FIG. 1, the bar is in a reversed position so that bottom face lies uppermost.

Figure 2:
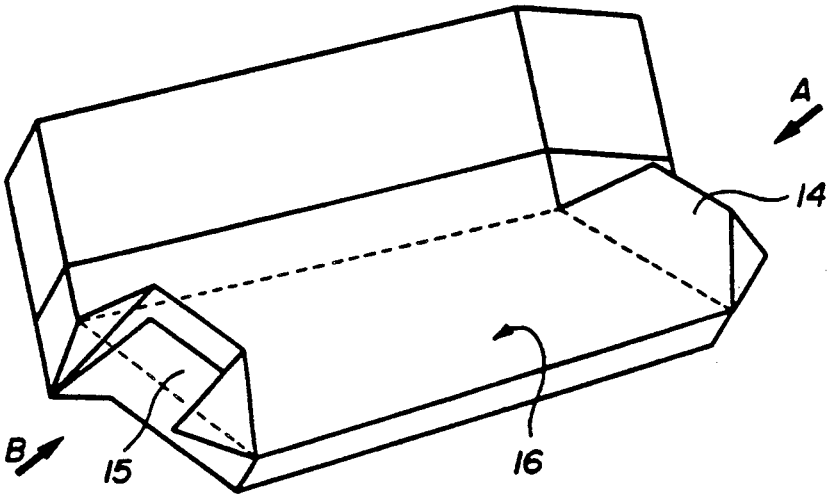
FIG. 2 represents a view identical with that of FIG. 1, but illustrating a subsequent phase of the method according to the invention.
Figure 3:
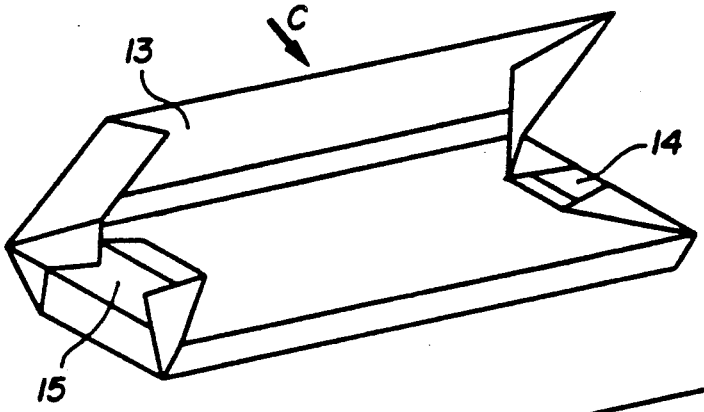
FIG. 3 represents the phase of folding the covering flap.
Figure 4:
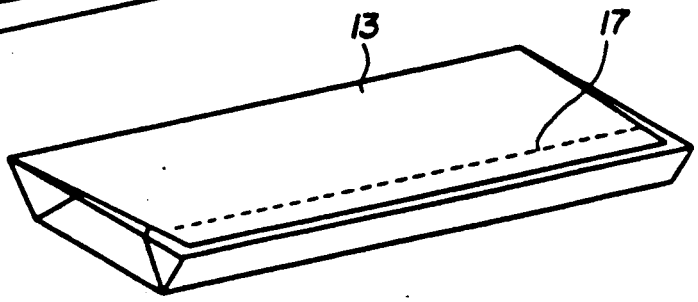
FIG. 4 represents a perspective view of the bar packaged according to the method of the invention.

As is shown in FIG. 2, the lateral folds 14 and 15 are next formed by pusher means acting in the direction of the arrows A and B. This technique is well known and will not be further described in detail herein. These lateral folds can be sealed when they are formed, or before or after they have been folded down. For forming said lateral folds, they are first applied against the lateral side faces of the bar so that the folds form a rectilinear line along the intersection lines of two adjacent side faces or along the "corners" of the bar. When the two lateral folds 14 and 15 are entirely folded down against the bottom face 16 of the bar, the covering flap 13 is folded down in the direction of the arrow C as is shown in FIG. 3, to achieve a packaged product such as is represented in FIG. 4. The covering flap 13 may be sealed at points or possibly glued along the line 17 or along at least a part of this line.

This method allows a package to be achieved which presents a conventional appearance, the lateral folds not being apparent, since they are covered by the covering flap.

For this purpose, the covering flap 13 Preferably has a sufficient width to cover nearly the entire bottom face 16 of the product. The top face presents a flat surface covering the whole face of the bar and may be used for advertising or any other printed information like trademarks and the like.

We claim:

1. A method of packaging a rectangular moulded chocolate bar having a predetermined thickness, an upper face and a bottom face and bevelled longitudinal and lateral side faces, with a packing material consisting of a sheet of a web of heat sealable, composite multilayer material, comprising the steps of forming a longitudinal tube of said packing material completely around the bar, so that the bar is located in a central part of said tube and so that one longitudinal edge of the sheet projects over and past another longitudinal edge and forms a covering flap, heat sealing said tube longitudinally throughout its length by sealing said other longitudinal edge against an inner surface of the base of said covering flap along a longitudinal edge of said bottom face of the bar, forming lateral folds which are first applied against the bevelled lateral side walls and then bent and applied on the ends of the bottom face near said lateral side walls, said lateral folds being made at each end of said tube, and folding said covering flap down over said bottom face in overlying relationship to said lateral folds.

2. The method of claim 1, including the step of at least partially sealing said covering flap against said sheet overlying said bottom face of said bar along a line parallel to a longitudinal edge of said flap, and located at the opposed edge of said sealed longitudinal edge.

3. The method of claim 2, wherein said covering flap has a width substantially equal to the width of said bottom face of said bar.

4. The method of claim 1, wherein said heat sealable, composite multilayer material is aluminum coated with a thermally-sensitive adhesive layer.

5. The method of claim 1, including the step of sealing said lateral folds before bending said folds down against said bottom face of said bar.

* * * * *